United States Patent [19]

Schmid

[11] Patent Number: 4,894,983

[45] Date of Patent: Jan. 23, 1990

[54] OPENING ROLLER FOR AN OPEN-END SPINNING ARRANGEMENT

[75] Inventor: Friedbert Schmid, Bad Überkingen, Fed. Rep. of Germany

[73] Assignee: Wilhelm Stahlecker GmbH, Fed. Rep. of Germany

[21] Appl. No.: 336,021

[22] Filed: Apr. 11, 1989

[30] Foreign Application Priority Data

Apr. 29, 1988 [DE] Fed. Rep. of Germany ..... 3814514

[51] Int. Cl.[4] ..... D01H 7/895; D01G 19/10

[52] U.S. Cl. ..... 57/408; 19/97

[58] Field of Search ..... 57/408, 412, 413; 19/97, 112–114

[56] References Cited

U.S. PATENT DOCUMENTS

| | | | |
|---|---|---|---|
| 4,044,427 | 8/1977 | Ankrom et al. | 19/97 |
| 4,163,304 | 8/1979 | Laflaquiere et al. | 19/97 |
| 4,196,496 | 4/1980 | Stauffer et al. | 19/97 |
| 4,272,865 | 6/1981 | Schmolke | 19/97 |
| 4,296,527 | 10/1981 | Eadie | 19/112 |
| 4,300,265 | 11/1981 | Heinen | 19/112 |
| 4,679,390 | 7/1987 | Stewart | 57/408 |
| 4,715,177 | 12/1987 | Stahlecker | 57/408 |

FOREIGN PATENT DOCUMENTS 3614033 11/1987 Fed. Rep. of Germany .

*Primary Examiner*—Donald Watkins

*Attorney, Agent, or Firm*—Barnes & Thornburg

[57] ABSTRACT

An opening roller for an open-end spinning arrangement is disclosed which contains a basic body pressed onto a shaft. This basic body contains an exchangeable ring mounting which is held by means of its end faces between a flange of the basic body and a tension disk. It is provided that the tension disk fitted onto the shaft is loaded in the axial direction by means of a screw which is screwed axially into the shaft and which, by means of the head, rests against the front face of the shaft. A spring element, preferably a cup spring, is arranged between the head of the screw and the tension disk.

7 Claims, 1 Drawing Sheet

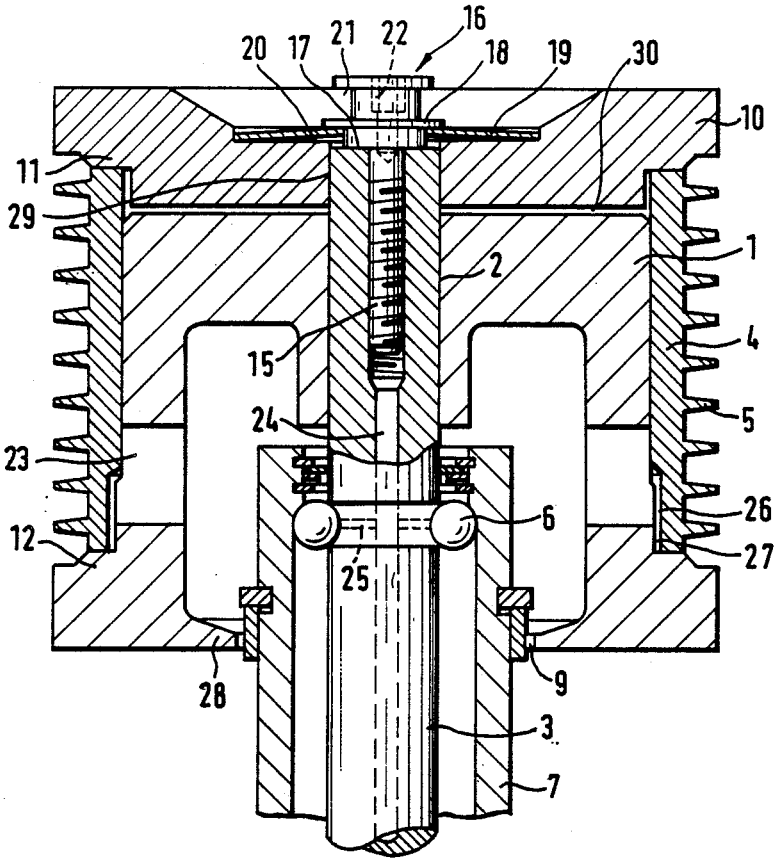
16
20
17
21
22
18
19
30
10
11
29
1
2
4
15
5
24
23
26
6
12
27
25
28
9
3
7

OPENING ROLLER FOR AN OPEN-END SPINNING ARRANGEMENT

BACKGROUND AND SUMMARY OF THE INVENTION

The invention relates to an opening roller for an open-end spinning arrangement, having a basic body, which is pressed onto a shaft, an exchangeable ring mounting being pushed onto this basic body and this ring mounting, by means of its front faces, being held between a flange of the basic body and a tension disk, which is fitted onto the shaft and which is loaded in axial direction by means of the head of a screw, which is screwed axially into the shaft.

An opening roller of the initially mentioned type is disclosed in German Published Examined Patent Application (DE-A) No. 36 14 033. This roller has the advantage that only one tolerance surface is required for the tension disk, specifically the tolerance surface with respect to the shaft. The tensioning disk is centered with respect to the shaft and is therefore relatively well balanced from the start. Even a disassembling with a subsequent reassembling of the tension disk does not result in any unbalanced masses; i.e., does not require any new balancing of the opening roller. It was found in practice that faulty handling may still occur during the mounting of this opening roller. If, during the mounting, the screw is tightened too much, the shaft will be Pulled toward the screw, causing the basic body, via the tensioning disk, to shift on the shaft. This results in the risk that the opening roller, on the whole, no longer sits in its correct operating position on the shaft, which may lead to disturbances in the machine equipped with this opening roller.

An object of the invention is to develop an opening roller of the initially mentioned type in such a manner that a faulty handling during the mounting is made impossible with a high degree of certainty.

This object is achieved in that the head of the screw, in the operative position, is fixed against the front face of the shaft, and in that a spring element is arranged between the head of the screw and the tension disk.

By means of this construction, it is ensured that the screw, during a mounting, must be tightened such that its head moves against a stop. A transmission of undue forces to the shaft or the basic body is made impossible in this case. The force transmitted to the tension disk, which is then transmitted further, via the ring mounting, to the basic body, is limited by the spring element. Undue stress to the tensioning disk is therefore securely avoided.

Other objects, advantages and novel features of the present invention will become apparent from the following detailed description of the invention when considered in conjunction with the accompanying drawings.

BRIEF DESCRIPTION OF THE DRAWING

The single drawing FIGURE is an axial sectional view of an opening roller constructed according to a preferred embodiment of the invention.

DETAILED DESCRIPTION OF THE DRAWING

The shown opening roller contains a shaft 3, which is disposed in a bearing housing 7 by means of roller bearings, of which only bearing 6 is shown in the drawing. The shaft 3, with both its ends, projects beyond the bearing housing 7. The end of the shaft 3, which is not shown, is equipped with a driving wharves by means of which the shaft 3 can be driven.

The actual opening roller is arranged on the shown end of the shaft 3 which is opposite the driving wharve, which is not shown.

A basic body 1 is pushed onto the shaft 3 by means of a press fit 2. This basic body 1 is pushed onto the shaft 3 in such a manner that the shaft 3 still projects beyond the basic body 1 on the side facing away from the bearing housing 7.

The basic body 1 reaches over the bearing housing 7 and, with a collar 28 facing the interior, forms a sealing gap 9 with the exterior side of the bearing housing 7. The area, over which the basic body 1 reaches, is accessible from the outside for a cleaning via at least one radial bore 23.

A ring mounting 4 with a slight sliding fit, is pushed onto the outer circumference of the basic body 1, which has a cylindrical outer surface. The ring mounting 4 is equipped with a mounting 5 consisting of teeth or needles. In a preferred embodiment, the mounting 5 is ground into the ring body so that the mounting 5 forms one piece with the ring 4.

The ring mounting 4, which covers the bore 23, is supported with a front face against a flange 12 of the basic body 1. In this area, the outer circumference of the basic body 1 is equipped with a light collar 27 to which a corresponding recess 26 of the ring mounting 4 is assigned. By means of the collar 27 and the recess 26, it is ensured that the ring mounting 4 cannot be slid on in a side-inverted manner.

The ring mounting 4 is braced against the flange 12 of the basic body 1 by means of a tension disk or ring 10 which rests by means of a flange 11 against a front face of the ring mounting 4 and loads the ring mounting 4 in axial direction with respect to the flange 12. The tension disk 10 is equipped with a central bore 29, by means of which it is fitted onto the shaft 3. The tension ring 10 and the ring mounting 4 are dimensioned such that a radial gap 30 remains between the basic body 1 and the tension ring 10. The tension ring 10 is braced in axial direction of the shaft 3 by means of a screw 15 against the ring mounting 4. The screw 15 is centrically screwed into the shaft 3. It has a head 16, which, in the screwed-in condition, rests against the front face of the shaft 3 by means of a contact surface 17. At an axial distance from this stop surface 17, a collar 18 is mounted at the head 16, this collar 18 serving as a contact surface for a cup spring 19, the exterior edge of which supports itself at the tension ring 10 in a corresponding indentation 20. The distance between the contact surface 17 and the collar 18 as well as between the indentation 20 is dimensioned such that the cup spring 19, in the operative position in which the head 16 of the screw 15 rests against the front face of the shaft 3 with the contact surface 17, is not totally compressed.

Between the collar 18 and the outer edge of the head 16 of the screw 15, a ring groove 21 is provided, which is used for the application of a tool, by means of which the whole opening roller, including its bearing housing 7, can be pulled in axial direction out of a corresponding bearing holding device. In addition, the head 16 of the screw 15, on the inside, is provided with a tool application surface 22, particularly a hexagon socket.

The shaft 3, as an extension of the threaded bore receiving the screw 15, is provided with an axial bore 24, from which transverse bores 25 branch off in the area of the bearings, of which only bearing 6 is shown. After the screw 15 is unscrewed, it becomes possible to supply the bearings 6 with a lubricant via the axial bore 24.

Although the present invention has been described and illustrated in detail, it is to be clearly understood that the same is by way of illustration and example only, and is not to be taken by way of limitation. The spirit and scope of the present invention are to be limited only by the terms of the appended claims.

What is claimed:

1. An opening roller for an open-end spinning arrangement, having a basic body, which is pressed onto a shaft, an exchangeable ring mounting being pushed onto this basic body, and this ring mounting, by means of its front faces, being held between a flange of the basic body and a tension disk, which is fitted onto the shaft and which is loaded in axial direction by means of the head of a screw, which is screwed axially into the shaft, wherein the head of the screw, in the operative position, is fixed against the front face of the shaft, and wherein a spring element is arranged between the head of the screw and the tension disk.

2. An opening roller according to claim 1, wherein a cup spring is arranged between the head of the screw and the tension disk.

3. An opening roller according to claim 1, wherein the head of the screw, is supported directly against the front face of the shaft with a stop surface.

4. An opening roller according to claim 2, wherein the head of the screw, is supported directly against the front face of the shaft with a stop surface.

5. An opening roller according to claim 1, wherein the head of the screw is provided with a collar which serves as a contact surface for the spring element.

6. An opening roller according to claim 2, wherein the head of the screw is provided with a collar which serves as a contact surface for the spring element.

7. An opening roller according to claim 3, wherein the head of the screw is provided with a collar which serves as a contact surface for the spring element.

* * * * *